US008337108B2

(12) United States Patent
Bouix et al.

(10) Patent No.: US 8,337,108 B2
(45) Date of Patent: Dec. 25, 2012

(54) SINGLE-USE COSMETIC SAMPLER

(75) Inventors: Herve F. Bouix, New York, NY (US); Christophe Jacob, Rouen (FR)

(73) Assignee: ELC Management LLC, New York, NY (US)

( * ) Notice: Subject to any disclaimer, the term of this patent is extended or adjusted under 35 U.S.C. 154(b) by 506 days.

(21) Appl. No.: 12/489,610

(22) Filed: Jun. 23, 2009

(65) Prior Publication Data

US 2010/0003064 A1 Jan. 7, 2010

Related U.S. Application Data

(60) Provisional application No. 61/075,797, filed on Jun. 26, 2008.

(51) Int. Cl.
*B43K 5/14* (2006.01)

(52) U.S. Cl. ..... 401/133; 401/132; 132/320

(58) Field of Classification Search ..... 401/132, 401/133; 132/320

See application file for complete search history.

(56) References Cited

U.S. PATENT DOCUMENTS

| | | | |
|---|---|---|---|
| 572,327 | A | 12/1896 | Bryan |
| 2,547,779 | A | 4/1951 | Renyck |
| 2,814,420 | A | 11/1957 | Elder, Jr. et al. |
| 3,128,920 | A | 4/1964 | Volckening et al. |
| 3,204,835 | A | 9/1965 | Michel |
| 3,469,928 | A | 9/1969 | Widegren |
| 3,777,949 | A | 12/1973 | Chiquiari-Arias |
| 4,248,227 | A | 2/1981 | Thomas |
| 4,284,199 | A | 8/1981 | Bigarella |
| 4,711,354 | A | 12/1987 | Bennett |
| 4,732,287 | A | 3/1988 | Bennett |
| 4,786,534 | A | 11/1988 | Aiken |
| 4,794,936 | A | 1/1989 | Zango |
| 4,854,760 | A | 8/1989 | Pike et al. |
| 4,889,228 | A | 12/1989 | Gueret |
| 4,952,204 | A | 8/1990 | Korteweg |
| 4,982,838 | A | 1/1991 | Fitjer |
| 5,320,217 | A | 6/1994 | Lenarz |
| 5,765,574 | A | 6/1998 | Sheffler et al. |
| 5,826,600 | A | 10/1998 | Rowe et al. |
| 5,862,818 | A | 1/1999 | Marinelli |

(Continued)

OTHER PUBLICATIONS

PCT International Search Report; International Application No. PCT/US2009/048451; Completion Date: Feb. 11, 2010; Date of Mailing: Feb. 11, 2010.

(Continued)

*Primary Examiner* — Tuan N Nguyen
(74) *Attorney, Agent, or Firm* — Martin W. Haerter

(57) ABSTRACT

A rigid single-use cosmetic container is provided wherein the basic elements, a tubular container and an applicator wand, are integrally formed as a unitary body. The wand extends inwardly from the top of the container into a product reservoir to form of an applicator end. The wand extends upwardly from the top end of the container to form a handle which may be provided in dimensions approximating the cap on a saleable package. An applicator, e.g., a brush, may be mounted on the applicator end of the wand. The container and wand are separated by a frangible connection in the top end of the container. When the frangible connection is broken, an opening is created in the top end of the container. The opening is sized to act as a wiper to remove excess product from the applicator when the wand is drawn from the container. The bottom margin of the container sidewall is provided with a substantially reduced thickness to permit the container to be pinched and hermetically sealed after the product reservoir is filled with a quantity of product.

11 Claims, 3 Drawing Sheets

U.S. PATENT DOCUMENTS

| | | | |
|---|---|---|---|
| 6,039,487 | A | 3/2000 | Kristiansen |
| 6,305,385 | B1 | 10/2001 | Szekely |
| 6,326,069 | B1 | 12/2001 | Barnett et al. |
| 6,572,296 | B2 | 6/2003 | Schrepf |
| 6,685,013 | B2 | 2/2004 | Discko, Jr. |
| 6,709,181 | B1 | 3/2004 | Montoli |
| 7,008,133 | B2 | 3/2006 | Ashe et al. |
| 7,219,801 | B2 | 5/2007 | Christian |
| 7,223,035 | B1 | 5/2007 | Engel |
| 2006/0283728 | A1 | 12/2006 | Patrick et al. |

OTHER PUBLICATIONS

PCT Written Opinion of the International Searching Authority, or the Declaration; International Application No. PCT/US2009/048451; Completion Date: Feb. 11, 2010; Mailing Date: Feb. 11, 2010.

SINGLE-USE COSMETIC SAMPLER

CROSS-REFERENCE TO RELATED APPLICATIONS

This application claims priority from U.S. provisional application 61/075,797, filed Jun. 26, 2008.

BACKGROUND OF THE INVENTION

1. Field of the Invention

The present invention relates to cosmetic product packages, such as disposable cosmetic product sample packages, intended for single use. In particular, the present invention is directed to a cosmetic product package molded in a single unitary body including a container, an applicator wand and a frangible connection between the container and wand that, when broken, forms a wiper means for metering the dispensed sample.

2. Description of the Prior Art

Single-use containers serve at least two important roles in the cosmetic field, i.e., as unit-dose dispensers or as samplers. Unit-dose dispensers conveniently provide to the user a pre-measured amount of product, e.g., enough product for a single treatment or application. Samplers (sample size packages of product) are generally provided to consumers free of charge or at a nominal cost so that a consumer can experience a limited quantity of a product prior to making a purchase decision. With respect to samplers, it is important that the experience of sampling the product closely approximates the experience of using a saleable package (the package available for purchase). It is also advantageous if when used as a sampler the package is not readily usable multiple times. If a free sampler is reusable and/or contains too much product, there is significantly less incentive for a consumer to purchase a saleable package.

Present samplers are often smaller versions of saleable packages. For example, mascara product samplers are often reduced volume versions of the saleable package, complete with a saleable-type re-sealable container with a threaded neck and cap, a rod, a brush applicator and an elastomer wiper insert. The cost of such samplers is relatively high due to the number and quality of parts (bottle, cap, rod, brush, wiper), complexity of structure, assembly and filling. In addition, because they can be resealed in an airtight fashion, the consumer can use such a sampler for several days or weeks, and thus has reduced incentive to purchase a corresponding saleable package.

Alternative samplers may be made by blow molding, extrusion or vacuum forming less expensive bottles, squeeze tubes or blister packs, respectively. However, these less expensive alternatives fail to provide a quality sampling experience that closely approximates the experience of using a saleable package. Furthermore, because these alternative sampler packages are generally non-rigid, the user may inadvertently apply too much pressure to the package and accidentally release or expel an undesired portion of product.

U.S. Pat. Nos. 4,732,287 and 4,711,354 to Bennett, respectively, disclose cosmetic dispensers including an elongated hollow cylindrical container with an opening, and an elongated plastic article (applicator rod) provided in the container with an enlarged portion sealed or welded in the opening of the container. The basic dispenser requires at least two main components, the cylindrical container and the article (applicator rod), that are separately manufactured and subsequently assembled, thus increasing production cost.

U.S. Pat. No. 2,814,420 to Elder, Jr., et al. discloses a sealed package and container with a tubular body, a frusto-conical section extending into one end of the body and a stem joined by a breakable annular zone to the frusto-conical section. The body, frusto-conical section and stem are formed as a unitary part. The tubular body is squeezable to facilitate expelling product from the product reservoir. Accordingly, product could be inadvertently expelled during normal handling if the user inadvertently applies excessive pressure. To avoid this problem, the frusto-conical section is inverted by the user from a position extending into the body to a position extending outwardly from the body. While this feature would appear to reduce the incidence of inadvertent release of product, it may not totally eliminate the problem. In addition, the stem does not extend down below the frusto-conical section, so it appears that it would be difficult if not impossible for the stem to be dipped into the product in the container. It appears as if the stem, in order to be used as an applicator, would need to be loaded with product by squeezing product from tubular body.

U.S. Pat. No. 6,039,487 to Kristiansen discloses a disposable dispenser comprised of a tube extending from an upper end of a container. An open bottom end of the container is sealed after the container is charged with product. Prior to filling and sealing, an applicator rod is inserted into the tube, which is adapted to internally receive in friction fit the upper end of the applicator rod. The region where the tube and the neck of the container are joined is weakened so that the tube can be snapped away from the container. Again, the basic package requires at least two components, the tube/container and the rod, which are separately manufactured and subsequently assembled.

U.S. Pat. No. 5,826,600 to Rowe et al. discloses a disposable dry-handle mascara applicator assembly. U.S. Pat. No. 4,952,204 to Kortweg discloses a dry handle swab assembly and unit. The containers disclosed in Rowe et al. and Kortweg are substantially the same as that disclosed in Kristiansen—a tube extending from an upper end of a container with an applicator rod secured in the tube. Each requires at least two basic components, the tube/container and the rod.

U.S. Pat. No. 6,709,181 to Montoli discloses a mascara product sampler substantially similar in construction to a saleable package, i.e., complete with a re-sealable container with a threaded neck and cap, a rod, a brush applicator and an elastomer wiper insert. The relative complexity of the manufacturing and assembly is self-evident.

Accordingly, there is a need for a less complex single-use, rigid container made substantially in one piece, and which includes an integral wand with an applicator end extending into a product reservoir, the wand capable of loading and distributing the contents of the container.

BRIEF SUMMARY OF THE INVENTION

It is an object of the invention to provide a single-use cosmetic container that is simple and substantially complete in a unitary body.

It is another object of the invention to provide a single-use cosmetic container suitable for use as a sampler or as a unit-dose dispenser.

It is yet another object of the invention to provide a basic one-piece single-use cosmetic container whose function can be enhanced with the addition of conventional applicator heads, e.g., a twisted wire mascara brush.

It is another object of the invention to provide a single-use cosmetic container with a product reservoir body that is sufficiently rigid to protect an applicator stored inside the body, and to prevent product ejection during use.

It is another object of the invention to provide a single-use cosmetic container that when used as a sampler substantially imitates the look and feel of a saleable container.

Accordingly, a rigid single-use cosmetic container is provided wherein the basic elements, a tubular container and an applicator wand, are integrally formed as a unitary body. The wand extends inwardly from the top of the container into a product reservoir to form an applicator end. The wand extends upwardly from the top end of the container to form a handle which may be provided in dimensions approximating the cap on a saleable package. The container and wand are separated by a frangible connection in the top end of the container. The bottom margin of the container sidewall is provided with a substantially reduced thickness to permit the container to be pinched and hermetically sealed after the product reservoir is filled with a quantity of product.

The applicator end of the wand may be used as is, e.g., as a dipper to retrieve product, or the end may be enhanced with texture (e.g., grooves, ridges, bores, bumps) or a spatula-like flattened portion to enhance product loading and/or delivery of product. Alternatively, the applicator end may be enhanced by securing an applicator to it. For example, a sponge, a fibrous material, flocking or a brush may be secured to the applicator end to enhance loading and delivery of the product sample.

The frangible connection is adapted to form an opening in the top end of the container that is dimensioned to wipe excess product from the applicator end and/or applicator. The opening is preferably dimensioned to approximate the size and function of the wiper in a corresponding saleable package for the same product.

Although the cosmetic container of the present invention appears to be a squeeze-tube type container, the container is actually substantially rigid, i.e., it is substantially inflexible under pressures associated with typical manipulation of packages of this type. Accordingly, the product and applicator are well protected, and inadvertent spillage or product ejection during handling is substantially avoided.

DETAILED DESCRIPTION OF THE INVENTION

Figure 1:
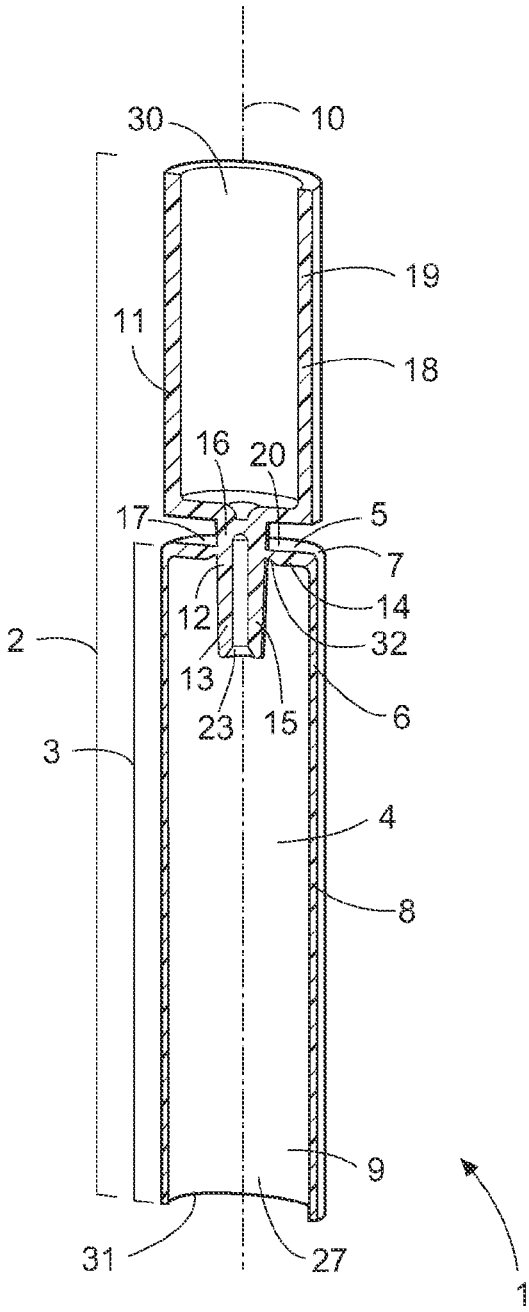
FIG. 1 is a cross-sectional, perspective view of a first embodiment of the unitary body of the present invention.
Figure 2:
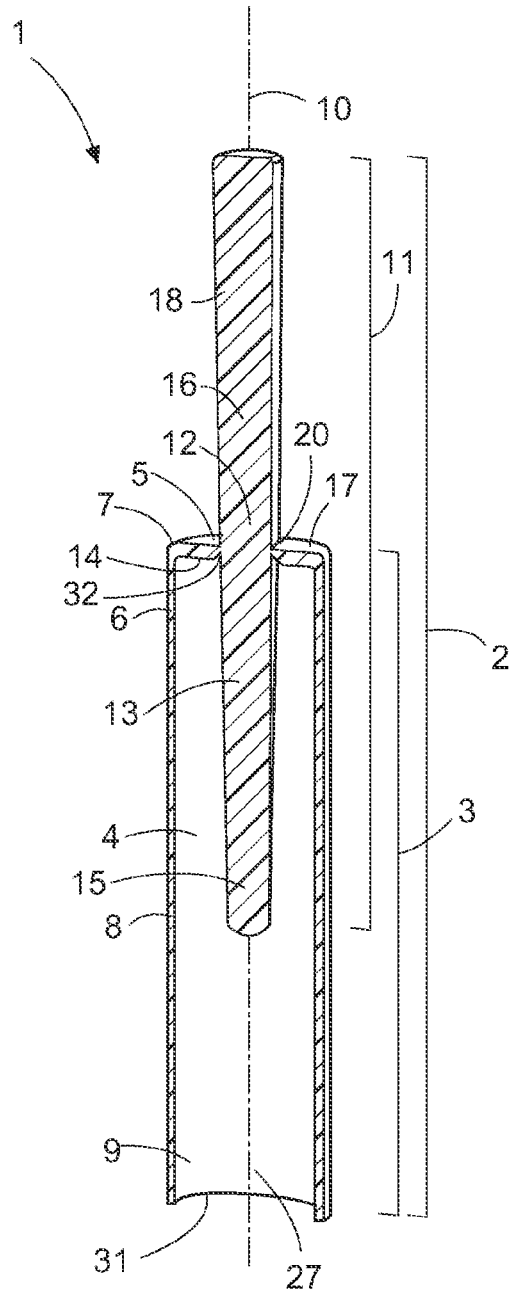
FIG. 2 is a cross-sectional, perspective view of a second embodiment of the unitary body.

Referring now to FIGS. 1-5, a single-use cosmetic container is shown generally at reference number 1. The container comprises a unitary body 2 including a substantially rigid container portion 3 defining a product storage reservoir 4. The container portion 3 has a top end wall 5 with an outer perimeter 7. At the perimeter 7, a side wall 6 depends from the top end wall 5 to form a tubular housing 8. The side wall 6 terminates at a bottom margin 9 that defines a temporary fill passage 27 (FIGS. 1 and 2). The bottom margin 9 is adapted to be hermetically sealed after the product reservoir 4 is filled through the fill passage 27. The bottom margin 9 is provided with a substantially reduced thickness relative to the rest of side wall 6 to facilitate sealing. The bottom margin 9 is sealed, for example, by heating to soften the reduced wall thickness of the margin, and then pinching the margin together to close the temporary fill passage 27. The pinched margin is bonded together by, for example, sonic welding, hot melt, adhesive or other known method. The container portion 3 further defines a longitudinal axis 10 extending through the top end wall 5, the product storage reservoir 4 and fill passage 27.

A wand 11 is arranged along the longitudinal axis 10. The wand 11 has a middle portion 12 integrally formed with the top end wall 5. A first end 13 of the wand 11 extends down from the middle portion 12 on an inner side 14 of the top end wall 5 into the product storage reservoir 4 and terminates in an applicator end 15 of the wand 11. A second end 16 of the wand 11 extends up from the middle portion 12 on an outer side 17 of the top end wall 5 and terminates in a handle end 18 adapted to be gripped by a user.

Figure 5:
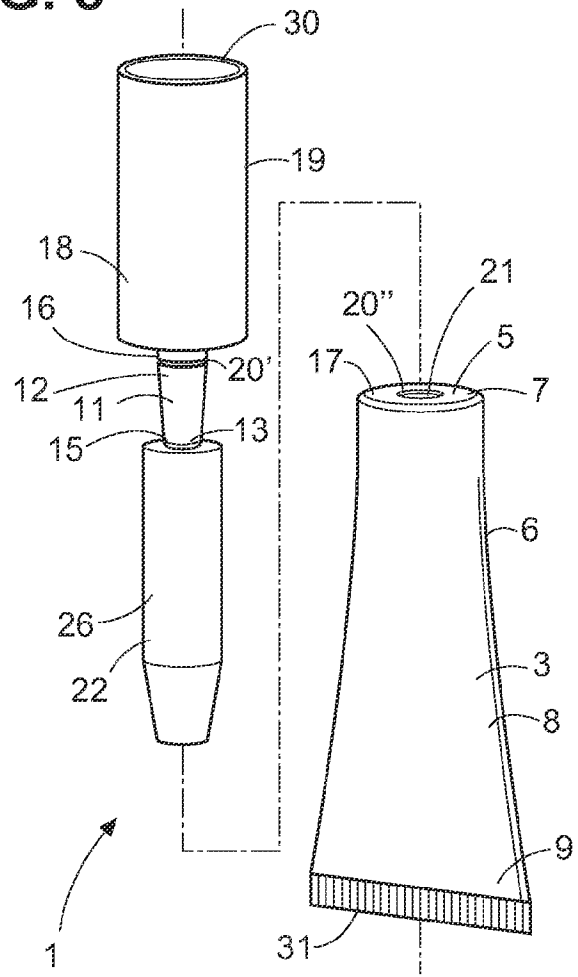
FIG. 5 is a perspective view of the embodiment shown in FIG. 3 with the frangible connection broken and the wand removed from the container.

A frangible connection 20 is located between the perimeter 7 of the top end wall 5 and the middle portion 12 of the wand 11. Frangible connection 20 is adapted to break and form an opening 21 (see FIG. 5) having a pre-determined size in the top end wall 5 when the handle end 18 is manipulated by the user, e.g., by twisting the handle end 18 relative to the container portion 3. In FIG. 5, reference numbers 20' and 20" indicate the corresponding opposing surfaces of a broken frangible connection 20. Before being broken, the frangible connection 20 surrounds the middle portion 12 of the wand 11. The frangible connection 20 comprises at least one annular groove 32 on the inner side 14 of the top end wall 5. The groove could similarly be provided in the outer side 17 of top end wall 5. The groove 32 is illustrated as immediately adjacent to the wand 11, however it may be spaced at any distance from the wand suitable to form opening 21 in a pre-determined size appropriate for wiping excess product from the applicator end 15 and/or applicator 22. An additional annular groove 33 may be provided in the wand 11 to facilitate formation of the opening 21.

For clarity, the unitary body 2, including the container portion 3, the wand 11 and the frangible connection 20 are integrally formed as a single unit by injection molding. This greatly reduces the cost of manufacturing and handling the container.

Figure 3:
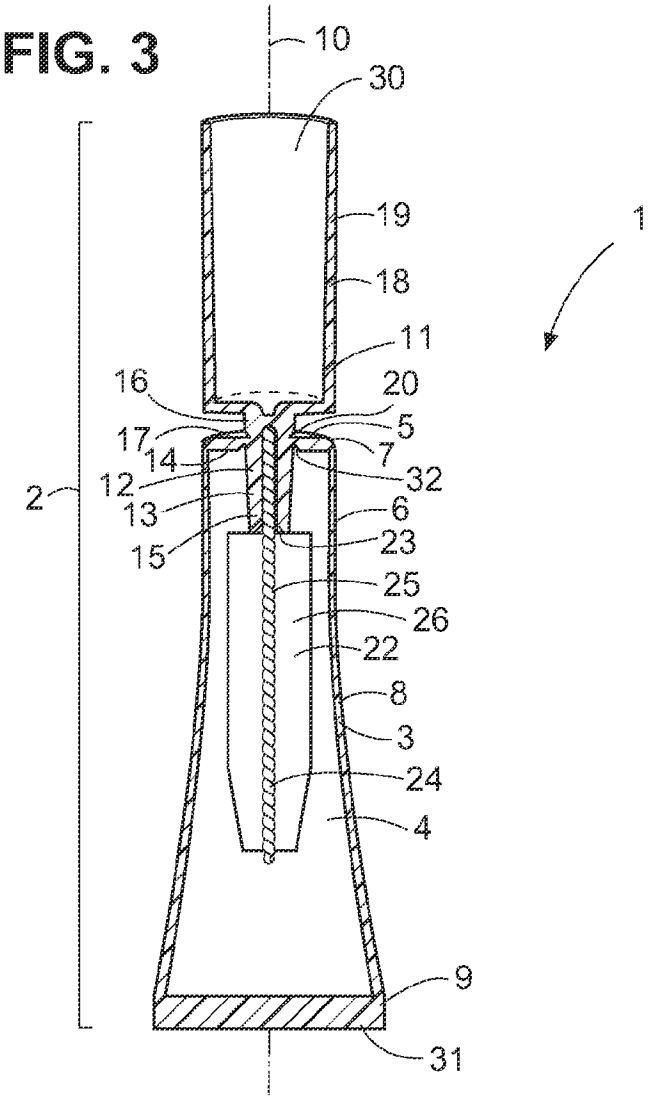
FIG. 3 is a cross-sectional view of the embodiment shown in FIG. 1 further showing schematically an applicator.
Figure 4:
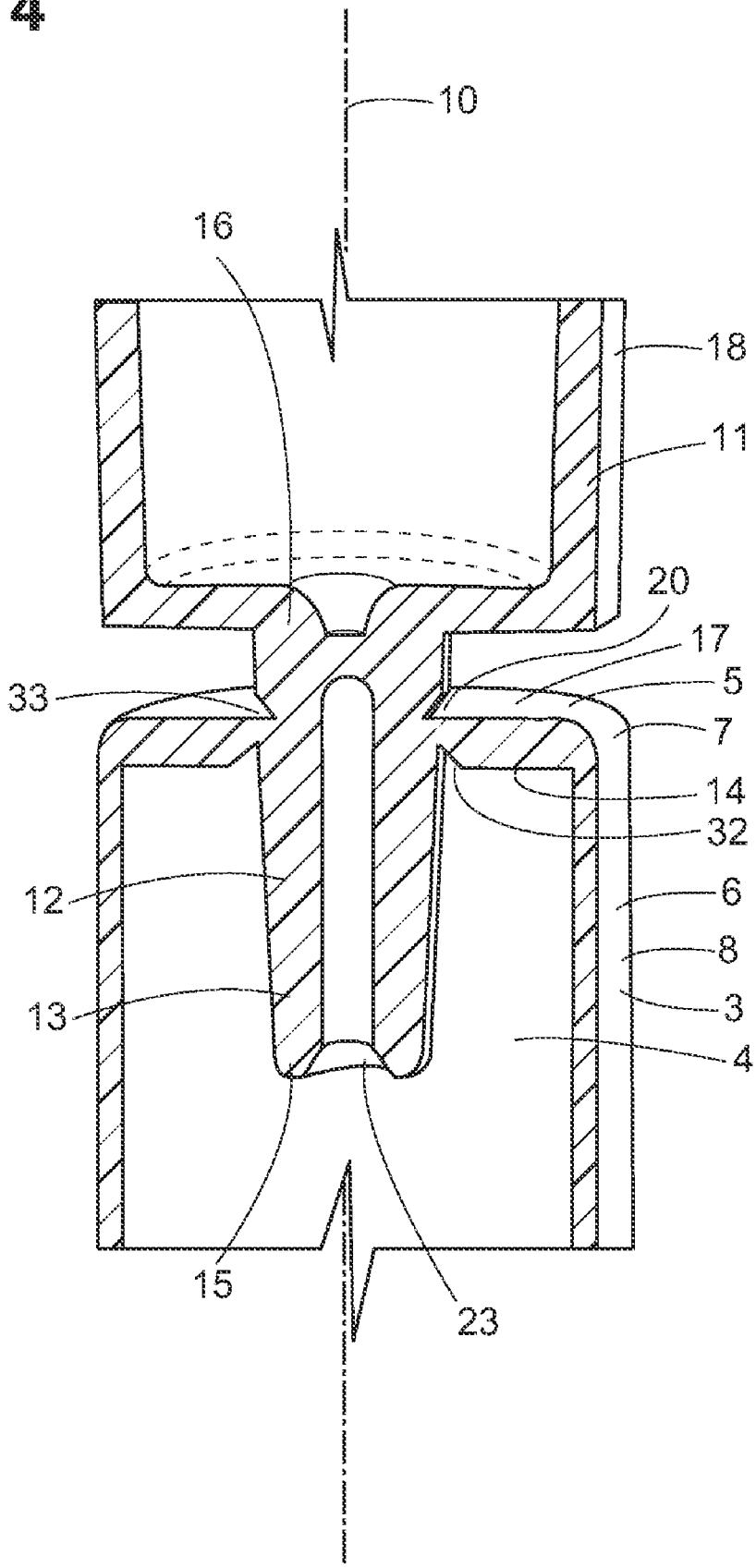
FIG. 4 is a partial view of the embodiment shown in FIG. 1, showing the frangible connection in greater detail.

The applicator end 15 of the wand 11 may be utilized in the form shown in FIG. 2 as, for example, a dipper, to load cosmetic product and transport it to a treatment area on the user. Alternatively, to enhance product loading and delivery, the applicator end can be enhanced with texture, e.g., holes, grooves, bumps, patterns or recesses, or shaped, e.g., a spatula (not shown). However, the applicator end 15 is preferably further adapted as shown in FIGS. 1, 3 and 5 to facilitate loading, transport and application of cosmetic product by, for example, securing an applicator 22 (shown schematically) to the applicator end 15. The applicator 22 can take the form of a fiber or foam pad, a sponge, a brush, a spatula, a flocked tip, a shaped elastomer tip or any other means suitable for loading, transporting and applying cosmetic products. The applicator 22 can be secured by conventional means, such as adhesive or sonic welding. Preferably, the applicator end 15 is adapted to support an applicator 22 by, for example, providing a bore 23 dimensioned to receive a stem 24 of an applicator 22 (FIG. 3). The stem 24 may take the form of a twisted wire core 25, as for example, the wire core of a typical mascara brush 26 (shown schematically). The stem or wire core 24, 25 may be secured in the bore 23 by any suitable means including, but not limited to, adhesive, sonic welding, press fit, or heat treatment.

Although in a preferred embodiment the filled and sealed cosmetic container of the present invention appears to be a squeeze-tube type container (see FIGS. 3, 5), the container is actually substantially rigid, i.e., it is substantially inflexible under pressures associated with typical manipulation of packages of this type. The rigidity of the container results from several factors. First, the unitary body 2 is injection molded. Injection molded containers of this size and type tend to be more rigid than, for example, extruded, blow molded or vacuum formed containers. Rigidity is further enhanced by selecting a material for the unitary body 2 and a thickness dimension for the sidewall 6 between the top end wall 5 and the bottom margin 9 to substantially resist deformation. The material and thickness of the side wall 6 are also selected to maximize compatibility with the product and prevent breakage.

One advantage of making the container substantially rigid is that the applicator 22 is protected from damage or deformation. This is particularly important for precision applicators such as the twisted wire mascara brush applicator 26. The bristles of such a brush can be damaged or deformed by constant or repeated undesired contact with flexible container walls. Another very important advantage of a rigid container is that it prevents the user from inadvertently squeezing product out through the opening 21. This prevents inconvenient spills or stains that may result from unexpected product expulsion from the container.

A disadvantage of making the container substantially rigid is that hermetic sealing of the bottom of the package is substantially more difficult due to the inflexibility of the sidewall 6. The present inventors have overcome this difficulty by reducing the thickness in the sidewall 6 along the bottom margin 9 of the sidewall. Accordingly, the sidewall 6 between the top end wall 5 and the bottom margin 9 has a first thickness sufficient to resist deformation when gripped or squeezed under normal use. The sidewall 6 in the vicinity of the bottom margin 9 has a second thickness less than the first thickness. The second thickness is selected to accommodate deformation of the side wall 6 sufficiently to permit hermetic sealing of the fill passage 27. In the preferred embodiment, the bottom margin 9 is pinched under heat and pressure to hermetically seal the fill passage 27 by welding after product has been filled into the product storage reservoir 4.

As an alternative to pinching the bottom margin 9 to seal the fill passage, a plug (not shown) dimensioned to fit in the fill passage 27 can be inserted. The plug can be hermetically secured to the bottom margin 9 by adhesive, welding, press-fit or other suitable means.

In the preferred embodiment shown in FIGS. 1, 3 and 5, the handle end 18 of the single-use cosmetic container is provided with an expanded hollow shell 19 that closely approximates the dimensions of a typical cap closure on a saleable (i.e., non-sampler) cosmetic package. As illustrated, the sampler is for a mascara product. The container portion 3 including the tubular housing 8, and the hollow shell 19 imitate proportionally and in actual dimensions the size of a typical saleable mascara container. In this way, the present invention provides to the consumer a product sampler with the look and feel of a saleable item, and thus gives the consumer in a sampler a quality product experience that closely approximates the experience of the saleable product available for purchase. The hollow shell 19 has an open end 30. To improve the appearance of the hollow shell handle, the open end 30 may be closed with an appropriately sized plug (not shown) that can be secured by adhesive, welding or press-fit.

The frangible connection 20 is adapted to form an opening 21 in the top end wall 5 that is dimensioned to wipe excess product from the applicator end 15 or applicator 22. The opening 21 is preferably dimensioned to approximate the size and function of a wiper in a typical saleable package. Typical conventional wipers have an opening with a diameter in the range of 3.5 mm to 4.5 mm. Accordingly, the frangible connection 20 should be adapted to have an opening 21 in the same range although some adjustment of the dimension of the opening 21 may be required to account for differences in saleable vs. sampler applicators, or differences in the structure of a typical wiper and the opening 21. For example, in the preferred embodiment, the middle portion 12 and first end 13 of the wand 11 has a diameter of approximately 3.7 mm. The opening 21 formed by breaking the frangible connection 20 is slightly larger than the diameter of the wand 11, i.e., slightly larger than 3.7 mm.

The unitary body 2 of the single use cosmetic container of the present invention is preferably made in a single piece by injection molding. The preferred material is high-density polyethylene (HDPE). Alternatively, the material of the unitary body may be low-density polyethylene (LDPE), polypropylene (PP) or other suitable plastic material. A mold comprising two or more sections is provided with a cavity dimensioned to form the unitary body 2. Suitable molten plastic is injected into the cavity through gates. The gates are positioned to facilitate flow of the molten plastic to all parts of the cavity, including the part of the cavity adapted to form the frangible connection 20. The mold is cooled sufficiently to allow the molten plastic to harden. The parts of the mold are then separated to release the completed unitary body. After the unitary body is formed, an applicator 22 (if desired) is secured to the applicator end 15 of the wand 11 within the product reservoir 4. The product reservoir 4 is then filled and the bottom margin 9 is hermetically sealed by, for example, welding, hot melt, adhesive or other known means. In the preferred embodiment, the bottom margin 9 is pinched or clamped under heat and pressure to hermetically seal the fill passage 27 by welding an approximately 5 mm wide section along the lower edge 31 of the bottom margin.

Alternatively, prior to injecting molten plastic into the mold cavity, an applicator such as, for example, a mascara brush, can be mounted in the mold such that the stem of the brush projects into the portion of the cavity adapted to form the applicator end of the wand. Molten plastic is subsequently injected such that the unitary body is formed, including the applicator end of the wand with the mascara brush stem securely embedded therein. Thus the stem of the mascara brush is over-molded into final position. This method eliminates the need to separately install the mascara brush in the applicator end after the unitary body is formed. The product reservoir is filled and the bottom margin is hermetically sealed by welding.

The single-use cosmetic container of the present invention serves as an excellent sampler as it provides a user with a quality product experience that closely approximates the experience of the saleable product available for purchase. However, it will contain a limited quantity of product, and because the container has a frangible connection between the container portion and the wand, the container and product within have a short life once opened (because the container cannot be resealed). Accordingly, it is only suitable for limited, essentially one-time, use. As the container cannot be resealed, any unused portion of sample product quickly dries out discouraging later use. Thus, by discouraging reuse, the container of the present invention minimizes any negative impact reuse might have on sales of saleable packages of cosmetic. The single-use container can be used for treatment, make-up, cleansing or other products.

The cosmetic container of the present invention can also be used as package for single-use type cosmetic applications. For example, some treatment products such as wrinkle reducers or spot removers are sold in single dose units. The present invention provides an ideal package for such dosed saleable products.

It is understood that various modifications and changes in the specific form and construction of the various parts can be made without departing from the scope of the following claims.

What is claimed is:

1. A single-use cosmetic container, comprising:

an integrally formed unitary body molded in a single piece including:

a rigid container portion defining a product storage reservoir, the container portion comprising a top end wall and a side wall depending from the top end wall to form a tubular housing, the side wall terminating at a bottom margin adapted to be hermetically sealed after the product reservoir is filled, the container portion further defining a longitudinal axis from the top end wall through the product storage reservoir; and a wand arranged along the longitudinal axis, the wand having a middle portion integrally formed with the top end wall, a first end of the wand extending down from the middle portion on an inner side of the top end wall into the product reservoir and terminating in an applicator end, and a second end of the wand extending up from the middle portion on an outer side of the top end wall and terminating in a handle end adapted to be gripped by a user; and a frangible connection between the top end wall and the middle portion of the wand, the frangible connection adapted to break and form an opening of a pre-determined size in the top end wall when the handle end is manipulated by the user, the predetermined size selected to wipe excess product from the applicator end of the wand.

2. The single-use cosmetic container of claim 1 wherein the applicator end is adapted to support an applicator.

3. The single-use cosmetic container of claim 2 further comprising an applicator secured to the applicator end.

4. The single-use cosmetic container of claim 2 wherein the applicator end further comprises a bore to receive an applicator.

5. The single-use cosmetic container of claim 4 further comprising an applicator with a twisted wire core, and a portion of the twisted wire core is secured in the bore by at least one of adhesive, sonic welding, press fit, or heat treatment.

6. The single-use cosmetic container of claim 5 wherein the predetermined size is further selected to wipe excess product from the applicator.

7. The single-use cosmetic container of claim 1 wherein the handle end further comprises an expanded hollow shell.

8. The single-use cosmetic container of claim 3 wherein the predetermined size is further selected to wipe excess product from the applicator.

9. The single-use cosmetic container of claim 1 wherein the side wall between the top end wall and the bottom margin has a first thickness sufficient to resist deformation when squeezed.

10. The single-use cosmetic container of claim 9 wherein the bottom margin has a second thickness less than the first thickness, the second thickness selected to permit deformation of the side wall sufficient to hermetically seal the package.

11. A single-use cosmetic container, comprising:

an integrally formed unitary body molded in a single piece including:

a rigid container portion defining a product storage reservoir, the container portion comprising a top end wall and a side wall depending from the top end wall to form a tubular housing, the side wall terminating at a bottom margin adapted to be hermetically sealed after the product reservoir is filled, the container portion further defining a longitudinal axis from the top end wall through the product storage reservoir, wherein the side wall between the top end wall and the bottom margin has a first thickness sufficient to resist deformation when squeezed and the bottom margin has a second thickness less than the first thickness, the second thickness selected to permit deformation of the side wall sufficient to hermetically seal the package; and a wand arranged along the longitudinal axis, the wand having a middle portion integrally formed with the top end wall, a first end of the wand extending down from the middle portion on an inner side of the top end wall into the product reservoir and terminating in an applicator end, and a second end of the wand extending up from the middle portion on an outer side of the top end wall and terminating in a handle end adapted to be gripped by the user; and a frangible connection between the top end wall and the middle portion of the wand, the frangible connection adapted to break and form an opening of a pre-determined size in the top end wall when the handle end is manipulated by the user, the predetermined size selected to wipe excess product from the applicator end of the wand.

* * * * *